US006409048B1

(12) United States Patent
Belzeski

(10) Patent No.: US 6,409,048 B1
(45) Date of Patent: Jun. 25, 2002

(54) PRESSURIZING DEVICE FOR A PERSONAL HYDRATION SYSTEM

(76) Inventor: Gregory L. Belzeski, 340 Old Saybrook, Boise, ID (US) 83706

( * ) Notice: Subject to any disclaimer, the term of this patent is extended or adjusted under 35 U.S.C. 154(b) by 0 days.

(21) Appl. No.: 09/858,317

(22) Filed: May 15, 2001

(51) Int. Cl.[7] ..... B65D 35/28

(52) U.S. Cl. ..... 222/103; 222/175; 224/148.2; 224/148.4

(58) Field of Search ..... 272/103, 214, 272/175; 224/148.2, 148.4

(56) References Cited

U.S. PATENT DOCUMENTS 2,915,222 A * 12/1959 Purinton ..... 222/175
4,551,136 A 11/1985 Mandl ..... 604/141
4,627,554 A * 12/1986 Leibinsohn ..... 222/103
5,105,984 A * 4/1992 Kazimir ..... 222/103
5,328,477 A 7/1994 Sitko ..... 604/134
5,427,290 A * 6/1995 Thatcher ..... 224/148.2
5,607,087 A 3/1997 Wery et al. ..... 222/610
6,070,767 A 6/2000 Gardner et al. ..... 222/175

* cited by examiner

*Primary Examiner*—Philippe Derakshani
(74) *Attorney, Agent, or Firm*—Stephen M. Nipper; Frank J. Dykas; Robert L. Shaver

(57) ABSTRACT

A pressurizing device for a personal hydration system of the type utilizing a bladder storing a quantity of hydrating fluid. The pressurizing device utilizes at least one compression plate which contacts the hydration bladder and is held thereon through use of at least one retaining band. Through such attachment, the fluid within the hydration bladder of the personal hydration system is pressurized and able to be more easily drawn into the mouth of a user of the personal hydration system.

21 Claims, 7 Drawing Sheets

PRESSURIZING DEVICE FOR A PERSONAL HYDRATION SYSTEM

This application incorporates by reference Disclosure Document No. 481741, dated Oct. 20, 2000, date stamped by the U.S. Patent and Trademark Office OIPE Oct. 26, 2000, filed by inventor Gregory Belzeski.

BACKGROUND OF THE INVENTION

The present invention generally relates to personal hydration systems, and more particularly relates to a method and apparatus utilized to pressurize hydrating fluids contained within a personal hydration system. Bicyclists, hikers, rowers, racers, walkers, and other athletes frequently utilize what are known as "personal hydration systems" to maintain adequate hydration while engaging in their respective activities. Other individuals may benefit from such a hydration system, such as construction workers, etc. These personal hydration systems typically have a bag-like fluid reservoir that is carried in a back or waist-mounted pack. A long, flexible hose is connected to the reservoir through a neck support at one end and terminates at a mouthpiece at the other end. The hose is long enough to allow the mouthpiece to be carried in the user's mouth to enable the user to draw or suck water from the reservoir at will. An example of such a personal hydration system is shown in U.S. Pat. No. 6,070,767 to Gardner et al. These systems are typically carried in an insulated back pack, with the hose exiting through a small hole.

As discussed in Gardner et al., a drawback to traditional personal hydration systems has been in the breath required to draw fluid from the reservoir. Particularly where a user is winded or out of breath, the drawing of fluid (by sucking) in an efficient and quick manner from such a personal hydration system can prove exceedingly difficult.

What is needed is a manner of pressurizing such a personal hydration system so as little or no breath power of a user is required to draw the fluid through the hose. Preferably, this method would allow a user to merely bite down on the mouthpiece valve of the bladder, thereby allowing a low pressure stream of hydrating fluid to be directed into the mouth of the user. The method needs to be simple to use, simple and inexpensive to manufacture, sturdy and reliable. The present invention solves these needs.

SUMMARY OF THE INVENTION

The present invention is a device and method for pressurizing a personal hydration system. Such a personal hydration system typically comprises a hydration bladder, a bag-like fluid reservoir which can be filled with hydration fluid, such as water. Such a hydration bladder may be any the shape, the most commonly comprised of an elongated bag. The invented device utilizes at least one compression plate held in contact with the hydration bladder through use of a retaining band or other means of compression. Holding the hydration bladder in such a manner results in compressive forces being applied to the external surface of the hydration bladder thereby pressurizing the fluid contained within the bladder so that subsequent activation of a mouthpiece attached to the hose extending from the bladder will result in the hydration fluid being expelled therefrom.

It is envisioned that one version of the present device will serve as a retrofit for existing personal hydration systems in one embodiment. In such an embodiment the user would fill a hydration bladder in the standard manner with fluid and then attach the present invention around the hydration bladder, thereby holding the fluid contained therein under pressure until activation of the mouthpiece or other containment device. Other versions of the present invention include the integration of the compression means into a backpack itself.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive.

DESCRIPTION OF THE PREFERRED EMBODIMENTS

Figure 1:
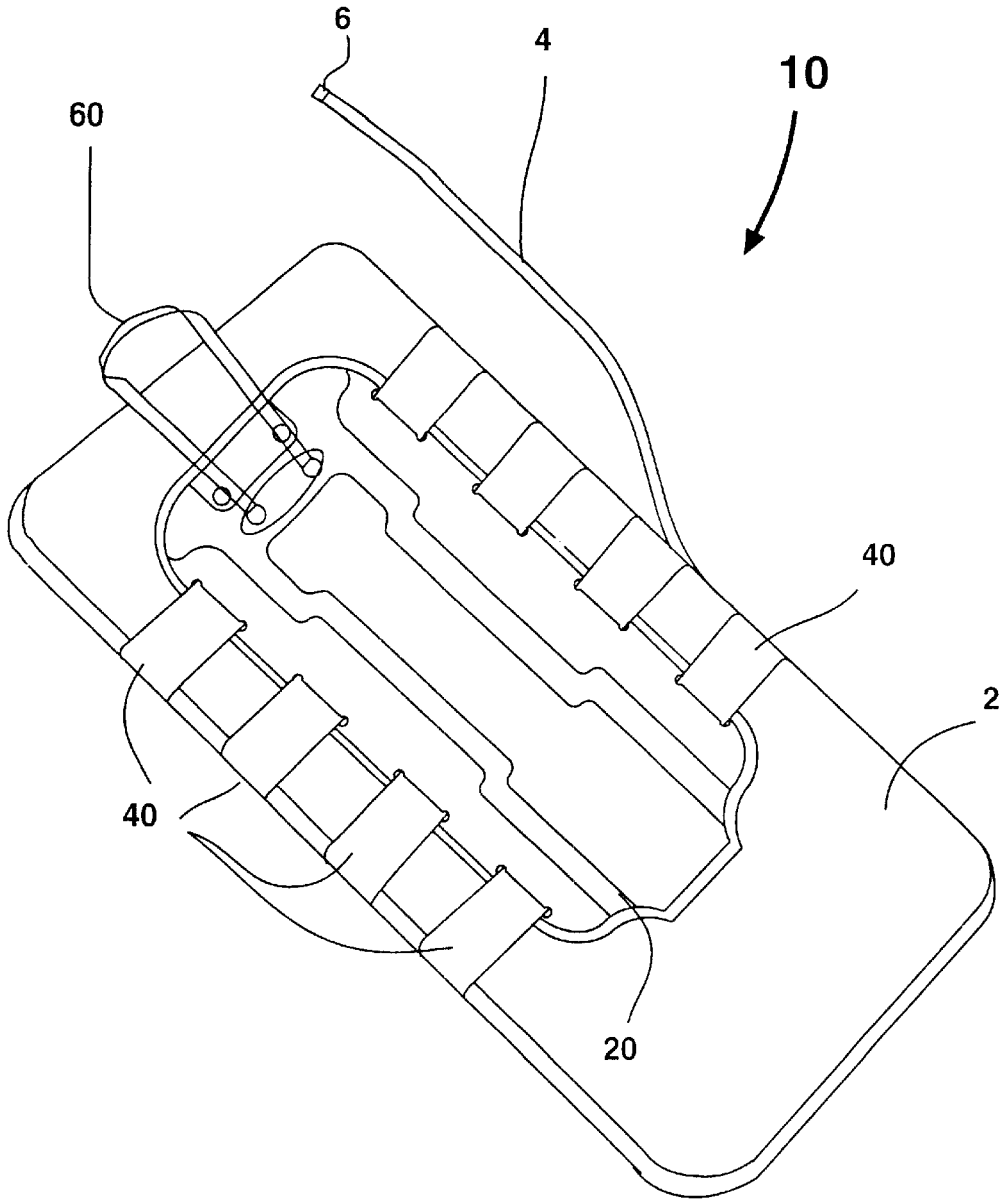
FIG. 1 is a perspective view of one embodiment of the present invention installed upon a hydrating bladder.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

The present invention is a pressurizing device for a hydration bladder. Referring initially to FIG. 1, one embodiment of the present invention is shown. The pressurizing device 10 is attached to a hydration bladder 2 having a hose extending to a mouthpiece 6. Such a hydration bladder 2 is commonly used by bicyclists and hikers. Typically, such a hydration bladder 2 has a bladder first side 101 and a bladder second side 102 (shown in FIG. 2).

In this embodiment, the pressurizing device 10 utilizes a compression plate or board 20 held upon the hydration bladder 2 through use of at least one retaining band or webbing 40. In such a way, the compression plate 20 contacts the bladder first side 101, generally conforming to the shape of the bladder first side. Optionally, a hand hold or hold rope 60 will be provided attaching to the pressurizing device 10 for allowing a user to easily grasp the present invention. This hand hold may further comprise means for wearing the device, such as backpack straps, or a waist belt. In this embodiment, utilized are four separate retaining bands 40 which are used to attach the pressurizing device 20 to the hydration bladder 2.

Figure 2:
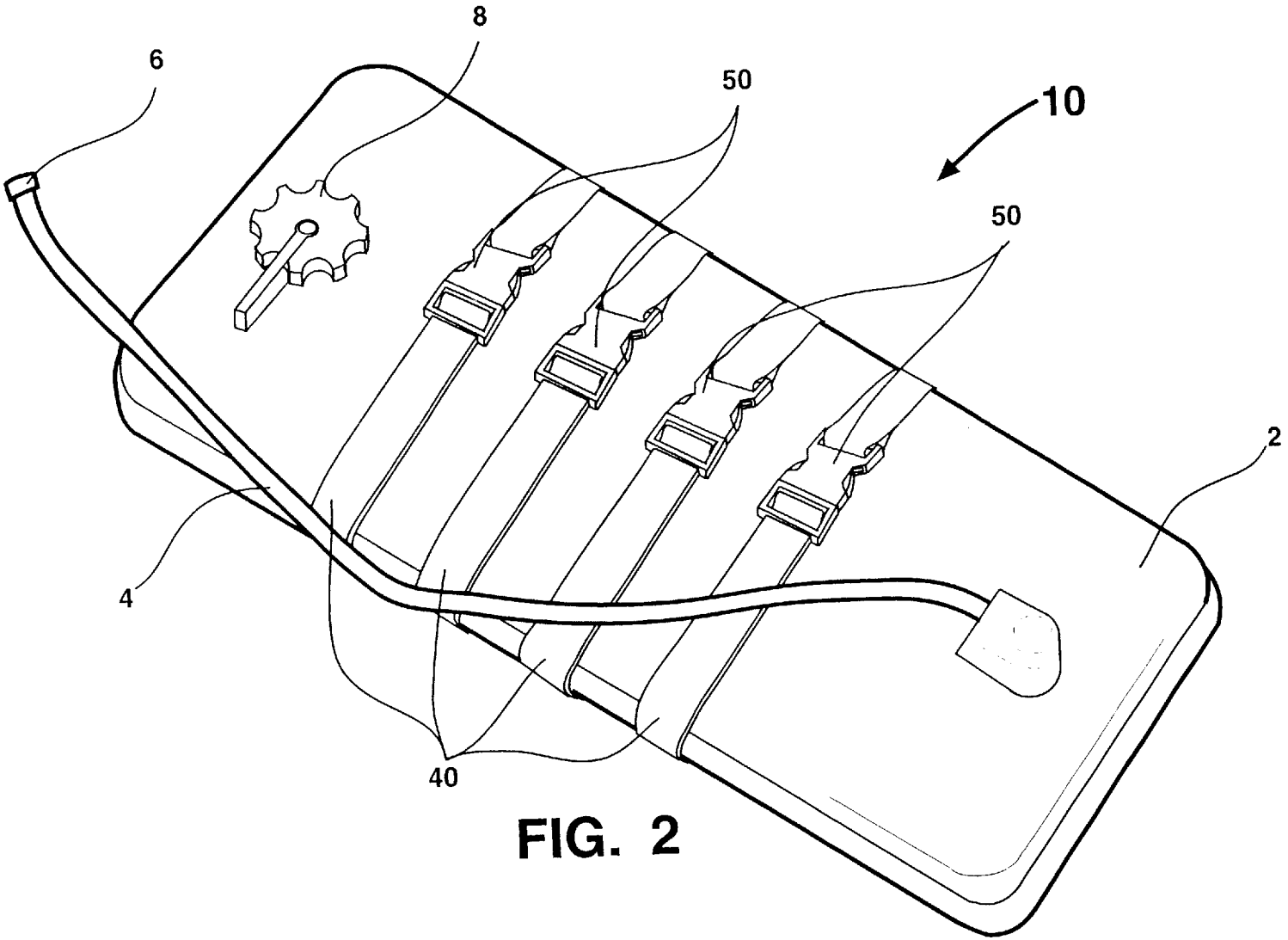
FIG. 2 is a perspective view of a second embodiment of the present invention installed upon a hydrating bladder.
Figure 3:
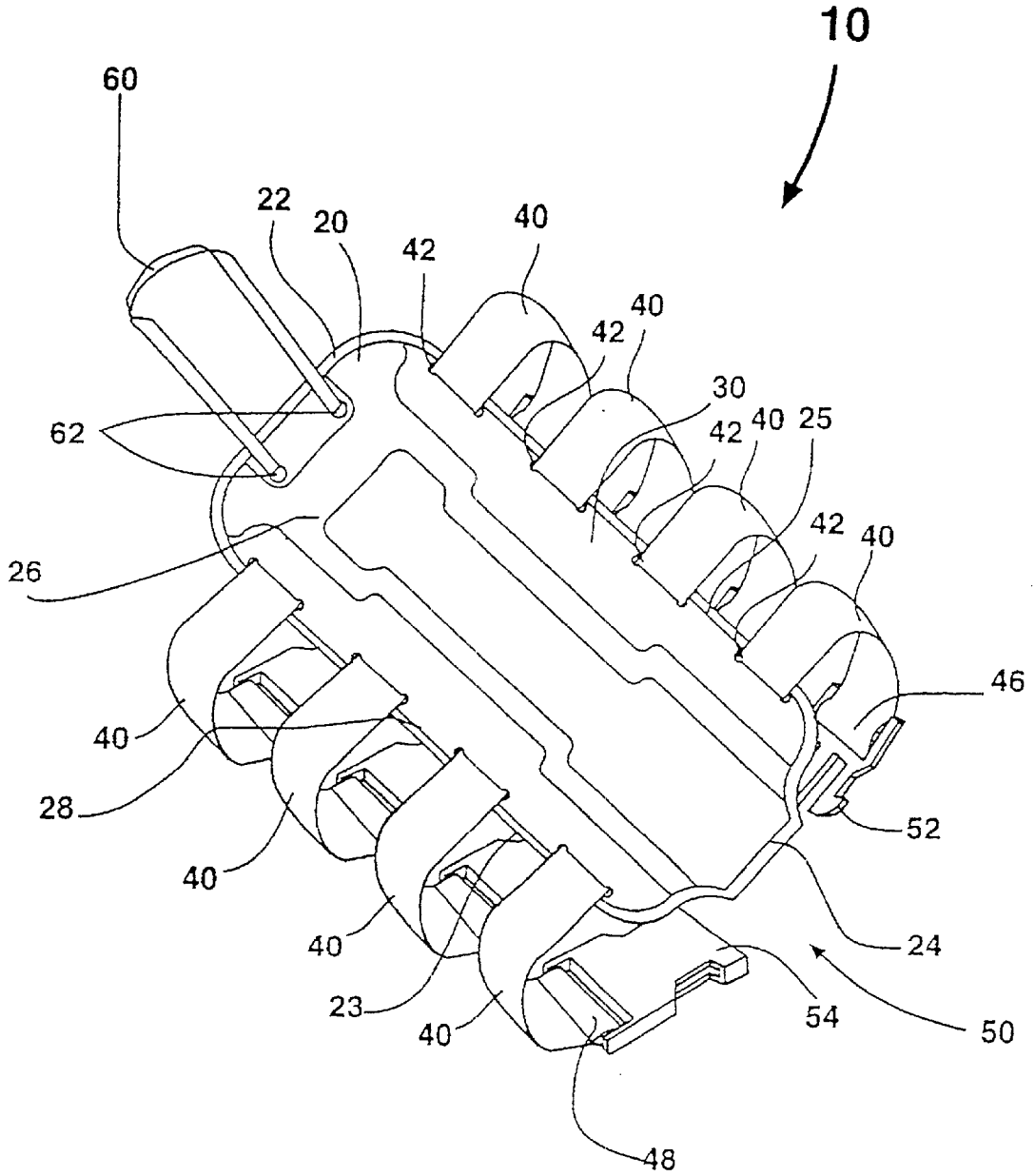
FIG. 3 is a perspective view of a third embodiment of the present invention.

Referring now to FIG. 2, a second embodiment of the present invention is shown. The hydration bladder 2 is further shown having a fill port 8 for allowing a user to fill the bladder. The retaining bands 40 extend and terminate in releasable snap buckles 50, these buckles having male plugs and female sockets (examples of which are shown in FIG. 3). While the preferred embodiment utilizes a retaining band and a snap buckle embodiment of a attachment, other methods of attaching and holding the compression plate on of the pressurizing device on the hydration bladder are also envisioned, including, but not limited to, hook-and-loop attachments, snaps, use of continuous bands rather than bands having ends, knots, etc.

Referring now to FIG. 3, a third embodiment of the present invention is shown. In this embodiment, the pressurizing device 10 utilizes a compression plate 20 having a first end 22 extending to a second end 24, thereby defining a length, and has a first side 23 extending to a second side 25, thereby defining a width. It is preferred that the compression plate 20 be composed of a flexible material such as a thermoplastic rubber, however less rigid and more rigid compression plates could also be used.

It is preferred that at least one rigid stiffener means be attached to or formed within the compression plate 20. In the embodiment as shown, the compression plate has an elongated center stiffener 26 extending lengthwise within the compression plate 20. The compression plate 20 also has a first side stiffener 28 and a second side stiffener 30. These side stiffeners 28, 30 are respectively located adjacent the first side 23 and the second side 25 of the compression plate 20.

At least one retaining band 40 or means of compressing is utilized to attach the pressurizing device 10 to the hydration bladder. In this embodiment, four retaining bands 40 are utilized for that purpose, running across the width of the bladder, circumscribing said bladder, with said retaining bands 40 contacting said bladder second side 102, as shown in FIG. 2. Running the bands across the length of the bladder or diagonally is also envisioned. The compression plate 20 has a retaining band attachments 42 for allowing the retaining bands to attach to the compression plate 20. In the embodiment shown, the retaining band attachments comprise holes through the first side 23 and second side 25 of the compression plate and through the side stiffeners which allow a first band end 46 of a band and a second band end 48 of a band to be inserted therethrough, this first band end 46 attaching to a male plug 52 of a releasable snap buckle 50 and the second band end 48 attaching to a female socket 54 of a releasable snap buckle 50. Such a releasable snap buckle 50 is shown is this figure. Other manners of attaching the retaining band 40 to the compression plate are also envisioned as well as other means of attaching the first band end and second band end together and engagement. Examples of such manners of doing so include hook-and-loop fasteners, use of a continuous retaining band, snaps, wire hooks, rubber or synthetic loops, clips, plastic "snap fit" clasps, elastic netting, and other means. It is preferred that these attachments be of a form not liable to cause damage to the bladder itself.

It is preferred that the compression plate 20 further comprise at least one hand hold attachment 62 such as the holes defined in the compression plate shown, for allowing a hold rope or hand hold 60 to attach to the compression plate 20.

Figure 4:
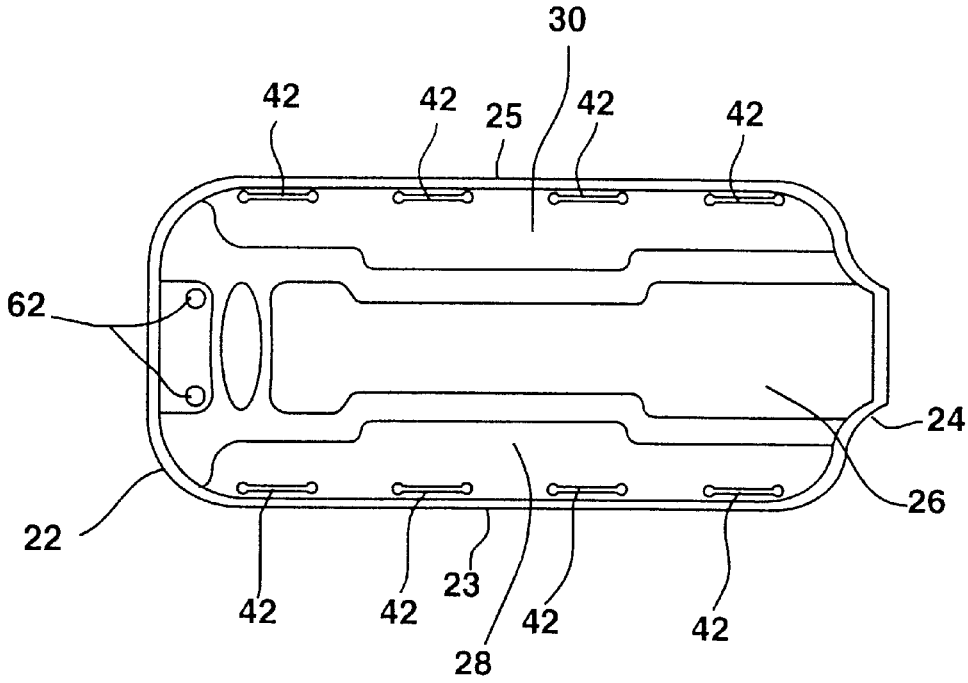
FIG. 4 is a side view of one embodiment of a compression plate utilized with present invention .

Referring now to FIG. 4, one embodiment of a compression plate 20 utilized with the present invention is shown. This embodiment shows a compression plate 20 having a first end 22 extending to a second end 24, as well as a first side 23 extending to a second side 25. Present within the center of the compression plate 20 is an elongated center stiffener 26 extending along the length defined by the first end to second end. Adjacent the first side 23 is located a first side stiffener 28, and adjacent the second side 25 is a second side stiffener 30. While this embodiment utilizes three separate stiffeners to stiffen the compression plate, the present invention may contain one or more stiffeners.

The first side stiffener 28 as well as the second side stiffener 30, in this embodiment, further comprise retaining band attachments 42 for allowing a retaining band or webbing to be there attached. These retaining band attachments comprise slots for allowing a retaining band to be inserted therethrough. Inclusion of such attachments is preferred because it reinforces the attachment point of the bands/straps/webbing.

The compression plate 20 further comprises a hold rope or hand hold attachment 62, such as the holes defined therein for allowing a hand hold to be attached thereto.

Being configured as such, this embodiment of compression plate is able to selectively flex and bend generally conforming to the shape of the hydration bladder there attached to. By having a compression plate itself comprised of a softer, more flexible material such as thermoplastic rubber, and the stiffener or stiffeners comprising a much more rigid material, such as polypropylene plastic, the invented pressurizing device is able to easily interfit with the hydration bladder itself, compressing it and allowing for easy expulsion of the hydrating fluid (water, sports drinks containing electrolytes, etc.) contained therein. In a less preferred embodiment, the compression plate itself could be rigid.

Figure 5:
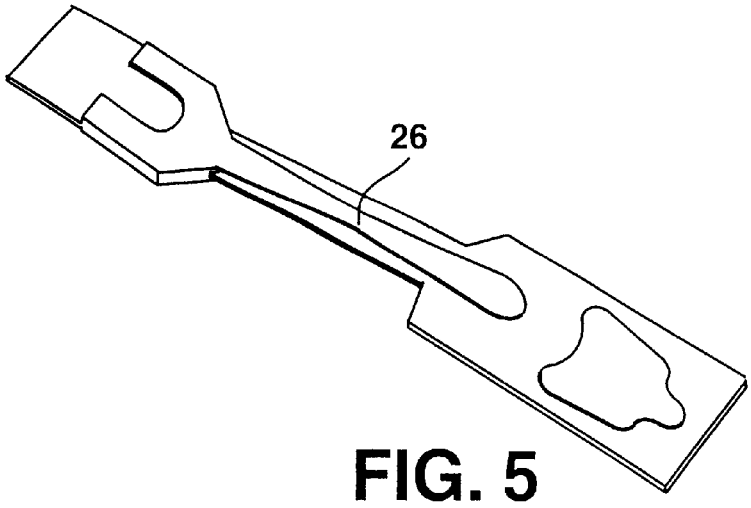
FIG. 5 is a perspective view of one embodiment of a center stiffener utilized with the present invention.
Figure 6A:
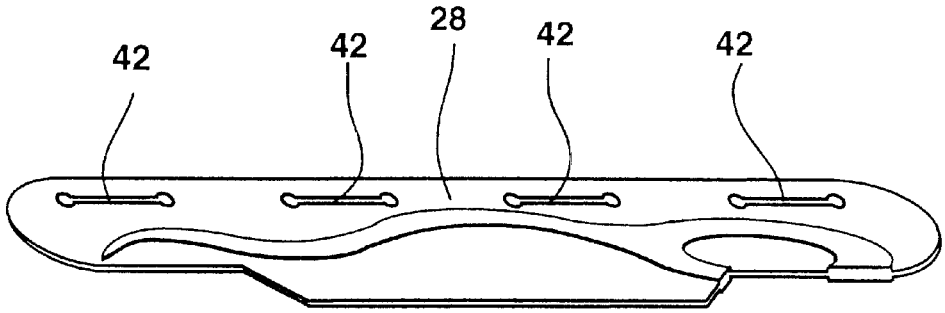
FIG. 6A is a first side perspective view of one embodiment of a first side stiffener utilized with the present invention.
Figure 6B:
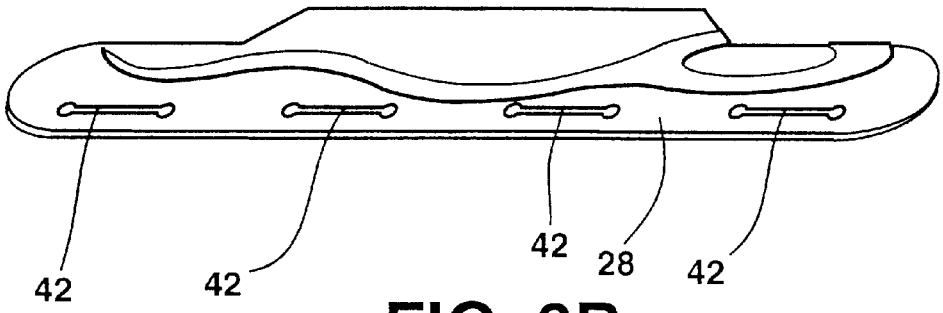
FIG. 6B is a second side perspective view of the embodiment of FIG. 6A.
Figure 7A:
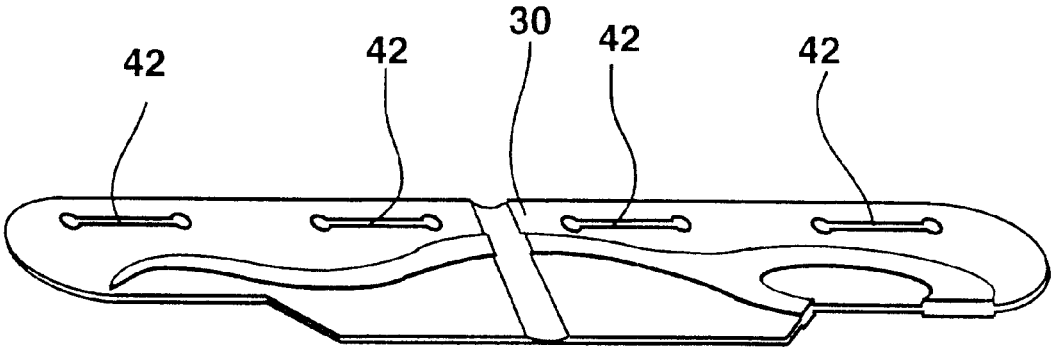
FIG. 7A is a first side perspective view of one embodiment of a second side stiffener utilized with the present invention.
Figure 7B:
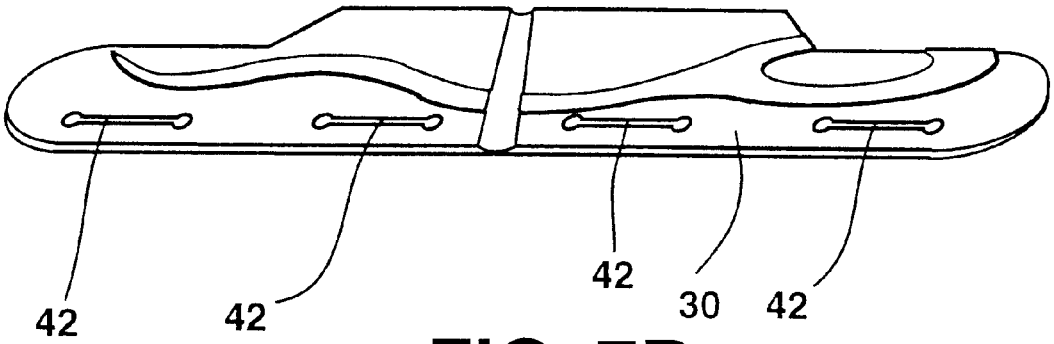
FIG. 7B is a second side perspective view of the embodiment of FIG. 7A.

Referring now to FIG. 5, one embodiment of the invented elongated center stiffener 26 is shown. It is preferred that this center stiffener be centered within or upon the compression plate, however other, non-centered locations are also envisioned. FIGS. 6A–6B show one embodiment of the first side stiffener 28, FIG. 6A showing a first side view and FIG. 6B showing a second side view. FIGS. 7A–7B show one embodiment of the second side stiffener 30, FIG. 7A showing a first side view and FIG. 7B showing a second side view. It is preferred that the side stiffeners be located symmetrically about the centerline of the compression plate, however other unsymmetrical orientations and arrangements are also envisioned. FIG. 7 shows one embodiment of the invented second side stiffener 30. As can be seen in FIGS. 6 and 7, the retaining band attachments 42 exist therethrough as well as through the compression plate itself.

Figure 8:
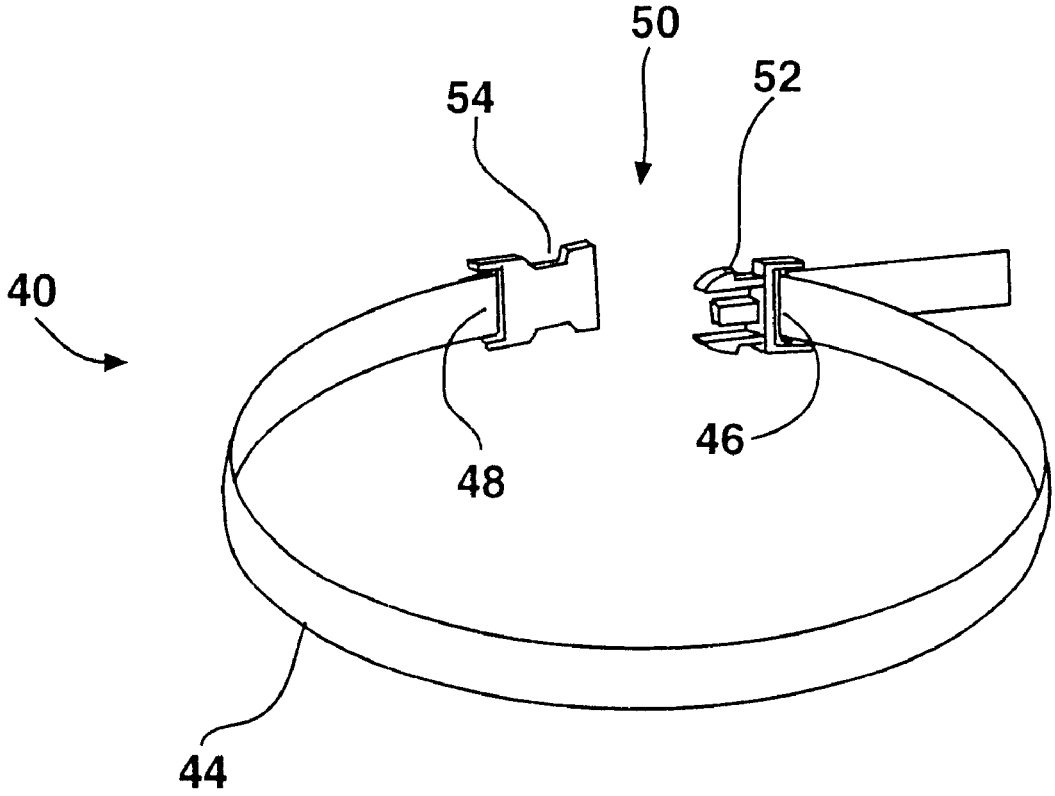
FIG. 8 is a perspective view of one embodiment of a retaining band utilized with the present invention.

Referring now to FIG. 8, one embodiment of a retaining band or webbing 40 utilized with the present invention is shown, this retaining band 40 having a band 44 extending from a first band end 46 to a second band end 48, with the first band end 46 attaching to a male plug 52 of a releasable snap buckle 50 and the second band end 48 attaching to a female socket 54 for releasable snap buckle 50.

In another embodiment, the present invention would comprise a pair of rigid plates sandwiching the bladder, held together through use of retaining band or other compressive means. In yet another embodiment, the present invention would comprise a rigid plate held against the bladder. Use of rigid plates are less preferred because they may be found by a user to be less comfortable, weigh more, and will be more difficult to install within the back pack. While, they are less preferred, they are alternative embodiments of the present invention.

In another embodiment, the present invention would be integrated into the back-pack or hip-pack which the bladder is carried in. In such an embodiment, the back-pack could be formed of a stiff material which serves as the rigid plate when a compression strap or band is used to hold the back-pack itself in contact with the bladder, etc.; or a rigid plate(s) could be formed into the back-pack, attached to the back-pack, or rest loosely within the back-pack, etc.; or the back-pack could be formed of an elastic material, have built-in elastic abilities, etc. so that the back-pack itself is able to squeeze a bladder stored therein. In another embodiment, the present invention itself may serve as the back-pack, having shoulder straps, hip straps, buckles, etc. In another embodiment, the present invention is merely a compression means for compressing at least a portion of the outside surface of the bladder, thereby pressurizing the fluid contained within the bladder. Such a compression means could include elastic bands, an elastic sleeve, non-elastic straps, webbing, etc.

In use of the preferred embodiment, a user would remove the hydration system's bladder from its back pack (if so contained). The bladder would then be filled with a quantity of hydrating fluid and sealed. The preferred embodiment of the present invention would then be attached to the bladder, thereby placing the fluid contained therein under pressure. The compressed bladder would then be placed back in it's insulated back pack (if so provided) and the user would stow the system in the normal manner for use.

The preferred embodiment of the present invention can be sold as a retrofit kit for allowing a user to retrofit a bladder he/she already owns, may be sold with a bladder, or may comprises an improved bladder itself by integrating the teachings of this invention into the bladder itself.

While there is shown and described the present preferred embodiment of the invention, it is to be distinctly understood that this invention is not limited thereto but may be variously embodied to practice within the scope of the following claims.

I claim:

1. An improved personal hydration system comprising:

a hydration bladder for containing a supply of hydrating fluid, said bladder having an outside surface, said bladder having a bladder first side and a bladder second side; and a compression means for compressing said outside of said hydration bladder thereby pressurizing said hydrating fluid within said hydration bladder, said compression means comprising a compression plate and at least one elastic retaining band;

wherein said compression plate has a plate first side and a plate second side, said compression plate for contacting said bladder first side;

wherein said retaining band attaches to said plate first side and to said plate second side, circumscribing said bladder, in circumscribing said bladder said retaining band contacting said bladder second side.

2. A pressurizing device for a personal hydration system having a hydration bladder, said hydration bladder having at least one side, said pressurizing device comprising:

at least one compression plate for contacting said hydration bladder at said side, said compression plate configured to generally conform to the shape of said hydration bladder side; and at least one retaining band for holding said compression plate in contact with said hydration bladder.

3. The pressurizing device of claim 2, wherein said compression plate composed of a flexible material.

4. The pressurizing device of claim 2, wherein said compression plate is composed of thermoplastic rubber.

5. The pressurizing device of claim 2, further comprising a handhold attaching to said compression plate for allowing a user to conveniently hold said device.

6. The pressurizing device of claim 2, wherein said compression plate is generally rectangular in shape, having first and second ends defining a length therebetween and first and second sides defining a width therebetween.

7. The pressurizing device of claim 6, in which said compression plate further comprises at least one rigid stiffener for stiffening said compression plate.

8. The pressurizing device of claim 7, wherein said rigid stiffener comprises an elongated center stiffener, said center stiffener generally centered within said compression plate and extending along said length of said compression plate.

9. The pressurizing device of claim 8, wherein said rigid stiffener further comprises first and second side stiffeners, said first side stiffener adjacent said compression plate first side, said second side stiffener adjacent said compression plate second side.

10. The pressurizing device of claim 9, wherein said first side stiffener and said second side stiffener further comprise at least one retaining band attachment for attachment of said retaining band to said compression plate.

11. The pressurizing device of claim 10, wherein said first side stiffener and said second side stiffener further each comprise four retaining band attachments for attachment of said retaining bands to said compression plate.

12. The pressurizing device of claim 7, wherein said rigid stiffener means is composed of polypropylene plastic.

13. The pressurizing device of claim 2, wherein said retaining band is composed of polyester elastic webbing and a fastener.

14. The pressurizing device of claim 13, wherein said fastener means comprises a releasable snap buckle having a male plug and a female socket.

15. The pressurizing device of claim 13, wherein said fastener means is configured to allow said fastener retaining band to be selectively shortened and lengthened.

16. A pressurizing device for a personal hydration system having a hydration bladder, said pressurizing device comprising:

a generally flexible compression plate for contacting said hydration bladder, wherein said compression plate further comprises at least one stiffener for stiffening said compression plate, wherein said compression plate is generally rectangular in shape, having first and second ends defining a length therebetween and first and second sides defining a width therebetween; and at least one retaining band for holding said compression plate in contact with said hydration bladder.

17. The pressurizing device of claim 16, wherein attaching to said compression plate is a rigid stiffener for stiffening said compression plate.

18. The pressurizing device of claim 17, wherein said rigid stiffener comprises an elongated center stiffener, said center stiffener generally centered within said compression plate and extending along the length of said compression plate, and wherein said rigid stiffener comprises first and second side stiffeners, said first side stiffener adjacent said compression plate first side, said second side stiffener adjacent said compression plate second side.

19. The pressurizing device of claim 18, wherein said first side stiffener and said second side stiffener further comprises at least one retaining band attachment for allowing said retaining band to attach to said compression plate.

20. A pressurizing device for a personal hydration system having a hydration bladder, said pressurizing device comprising:

a flexible compression plate for contacting said hydration bladder, wherein said compression plate further comprises at least one stiffener for stiffening said compression plate, wherein said compression plate is generally rectangular in shape, having first and second ends defining a length therebetween and first and second sides defining a width therebetween;

a rigid stiffener means attaching to said compression plate, wherein said rigid stiffener means comprises an elongated center stiffener, said center stiffener generally centered within said compression plate and extending along the length of said compression plate, wherein said rigid stiffener means comprises first and second side stiffeners, said first side stiffener adjacent said compression plate first side, said second side stiffener adjacent said compression plate second side, wherein said first side stiffener and said second side stiffener further comprises at least one retaining band attachment for allowing said retaining band to attach to said compression plate; and at least one retaining band for holding said compression plate in contact with said hydration bladder, said retaining band further comprising a fastener.

21. A pressurizing device for a personal hydration system having a hydration bladder, said pressurizing device comprising:

at least one compression plate for contacting said hydration bladder, wherein said compression plate is generally rectangular in shape, having first and second ends defining a length therebetween and first and second sides defining a width therebetween, wherein said compression plate further comprises at least one rigid stiffener for stiffening said compression plate; and at least one retaining band for holding said compression plate in contact with said hydration bladder.

* * * * *